United States Patent [19]

Lang et al.

[11] 4,330,034

[45] May 18, 1982

[54] TWO-PASS HEAT EXCHANGER

[76] Inventors: Helmut Lang, Lindenhof 8, 5430 Wettingen; Peter Wollschlegel, Niederwiesstrasse 4, CH-5417 Untersiggenthal, both of Switzerland

[21] Appl. No.: 62,428

[22] Filed: Jul. 31, 1979

[30] Foreign Application Priority Data

Jun. 20, 1979 [CH] Switzerland ..... 5735/79

[51] Int. Cl.[3] ..... F28B 9/02

[52] U.S. Cl. ..... 165/113; 165/146; 165/174

[58] Field of Search ..... 165/174, 178, 110–114, 165/146; 138/38

[56] References Cited

U.S. PATENT DOCUMENTS

| | | | |
|---|---|---|---|
| 731,194 | 6/1903 | Lovekin | 165/174 |
| 1,184,936 | 5/1916 | Falkenwalde | 138/38 |
| 2,310,234 | 2/1943 | Haug | 165/174 |
| 2,310,927 | 2/1943 | Bay | 165/110 |
| 2,620,830 | 12/1952 | Schultz | 165/178 |
| 2,664,109 | 12/1953 | Iager | 138/42 |
| 2,806,718 | 9/1957 | Cook et al. | 165/174 X |
| 3,073,575 | 1/1963 | Schulenberg | 165/174 X |
| 3,209,820 | 10/1965 | Lauterbach | 165/174 |
| 3,451,472 | 6/1969 | Keck | 165/174 |
| 3,707,186 | 12/1972 | Zorrilla et al. | 165/178 |
| 3,731,735 | 5/1973 | Ris | 165/110 |
| 3,830,293 | 8/1974 | Bell | 165/114 X |
| 3,844,588 | 10/1974 | Jocsak | 165/178 |
| 4,220,194 | 9/1980 | Shade, Jr. et al. | 165/114 X |

FOREIGN PATENT DOCUMENTS

| | | | |
|---|---|---|---|
| 265334 | 10/1968 | Fed. Rep. of Germany | 165/174 |
| 1814191 | 6/1970 | Fed. Rep. of Germany | 165/174 |
| 1811596 | 4/1972 | Fed. Rep. of Germany | 165/174 |
| 1958840 | 7/1972 | Fed. Rep. of Germany | 165/146 |
| 2215369 | 10/1973 | Fed. Rep. of Germany | 165/113 |
| 2507870 | 9/1975 | Fed. Rep. of Germany | 165/174 |
| 883970 | 7/1943 | France | 138/42 |
| 1172604 | 2/1959 | France | 165/174 |
| 764 | of 1856 | United Kingdom | 138/38 |
| 109884 | 10/1917 | United Kingdom | 138/38 |
| 900407 | 7/1962 | United Kingdom | 165/114 |
| 1161685 | 8/1969 | United Kingdom | 165/174 |
| 1240113 | 7/1971 | United Kingdom | 165/103 |
| 1247429 | 9/1971 | United Kingdom | 165/178 |
| 1344812 | 1/1974 | United Kingdom | 165/134 R |

*Primary Examiner*—Sheldon J. Richter

*Attorney, Agent, or Firm*—Burns, Doane, Swecker & Mathis

[57] ABSTRACT

In order to reduce the difference in stress of the tubes through which heating steam is flowing in the case of heat exchangers where the tubes are concentrated in at least two horizontal bundles and where heating steam flows through the tubes and a power medium flows around the tubes, it is proposed that there are arranged at the intake openings of the tubes (1) through which the heating steam is flowing baffles (3) with different intake profiles (4) in such manner that within each bundle of tubes the intake profiles (4) will become smaller in direction of flow of the power medium to be heated.

7 Claims, 3 Drawing Figures

TWO-PASS HEAT EXCHANGER

BACKGROUND AND SUMMARY OF THE PRESENT INVENTION

The present invention concerns a heat exchanger. Heat exchanger tubes are concentrated in at least two horizontally arranged bundles, with heating steam flowing within the tubes and with a power medium, to be heated up, flowing around the tubes. The heating steam flows serially through the bundles or nests of tubes and the power medium flows serially around the nests of tubes. The several bundles are connected upstream with an inlet manifold and downstream with a drainable collecting chamber. The several nests of tubes possess different heat-exchanging surfaces which are arranged such that the cross-sectional area of the nests of tubes, through which the heating steam is flowing, will decrease in direction of the heating steam flow. Steam-heated heat exchangers of this type, used for example to superheat exhaust steam of high-pressure turbines in nuclearly heated saturated steam turbine plants, where the heat-dissipating heating steam is condensed in the course of several pass-throughs in order to attain a maximum thermal flow rate and to maintain safety of operations, are known (see published German patent application No. 22 00 916). At each pass-through there is being condensed only such quantity of heating steam that, even in the case of the most disadvantageously placed tube, the steam/condensed-water flow at the tube end will be free of instabilities which could cause periodic fluctuations in the temperature of the tube wall and thus permanent damages of the tubes or the joint between tube and tube base. The condensed water is removed from the heating steam when it commences its next pass-through in order to facilitate thermal dissipation and to avoid pressure losses at the flow through the next bundle of tubes. Heat exchangers of this type can be formed by straight-line tubes or by U-shaped tubes, the latter offering the advantage that slight differences in thermal elongation of the tubes can be controlled with greater ease.

It has been proposed to employ pin-hole plates, mounted at the intake end of each nest of tubes, for a precise throttling of the heating steam. Such pin-hole plates have the disadvantage that a seal between the individual banks of tubes can not be attained because the beads of the tube welds will protrude in an irregular manner so that unwanted by-passes will be formed. It is further necessary to attach the plate in such manner that it will be able to move because inadmissibly high thermal stresses would be generated otherwise. Finally, the plate is so large that it can not be removed in one piece when the steam chamber has been welded together.

Tube sections, introduced into the intermediate superheater tubes at their intake side, have also been used. Each tube section is divided at its longitudinal center and a pinhole diaphragm is welded into this spot. This arrangement has the disadvantage that the insert tube section can not be readily removed after its installation, making it impossible for all practical purposes to inspect the tube inside. Furthermore, the manufacture of such tube sections is costly.

It is the object of the present invention to establish a throttling arrangement for a heat exchanger which will make possible a reduction in the number of heating steam pass-throughs without affecting the safety of operation, namely by adjusting the flow rate of the heating steam in functional relation to the thermal load of the various tubes. The manufacture of the throttling arrangement should be simple and inexpensive, and the assembly as well as the disassembly of the throttling arrangement should be possible without any difficulties.

The invention solves this problem by providing, at the intake openings of the tubes through which the heating steam is flowing, baffles with different intake profiles. Within each nest of tubes the intake profiles become smaller in a direction of flow of the power medium to be heated.

The frontal arrangement of baffles makes it possible to relate the flow rate of the heating steam precisely to the thermal load ($\Delta T$) of each tube so that the scavenging steam rate at the tube will correspond to the minimum rate of flow which is required. Since the over-all pressure losses for the condensation process are very low, the thermodynamic loss caused by the throttling will be so low that it can be disregarded. This arrangement makes it also possible to keep the number of heating steam pass-throughs to a minimum without affecting the safety of operation of the aggregate by relating the flow rate of the heating steam to the existing thermal load of the tubes.

An advantageous further development of the invention object provides that the baffles are formed by a slotted, cylindrical baffle body with a collar defining the baffle opening. The collar's outer diameter is greater than the intake opening of the tube.

It is also preferable to provide the surface of the baffle body with a tapered trailing edge in order to eliminate any flow separation. The outer surface of the baffle body can further be provided with an eccentric relief adjacent to the collar.

The placement of the baffle in front of the tube intake eliminates the need for a calm region in front of the baffle, and a more precise balancing of the pressure drop based on a number of flow-throughs unaffected by the steam flow velocity will facilitate the layout of the heat exchanger. The slotted, cylindrical form of the baffle body permits, due to its inherent elasticity, an equalization of differences in thermal expansion. The simple geometry of the baffle bodies makes it possible to manufacture such bodies precisely and economically. The baffle bodies of the present invention can be installed in a simple manner by driving them into the tube intake openings. A correspondingly simple disassembly allows an inspection of the tube inside and of the joint connecting the tube with the tube base without costly prior preparations. This baffle system also permits a quick adjustment in response to changes in operating conditions when scavenging steam is present in excessive or insufficient quantities.

BRIEF DESCRIPTION OF THE DRAWING

A preferred embodiment of the present invention will now be described in more detail with reference to the accompanying drawings wherein like members bear like reference numerals and wherein.

DETAILED DESCRIPTION OF THE PREFERRED EMBODIMENTS

Figure 1:
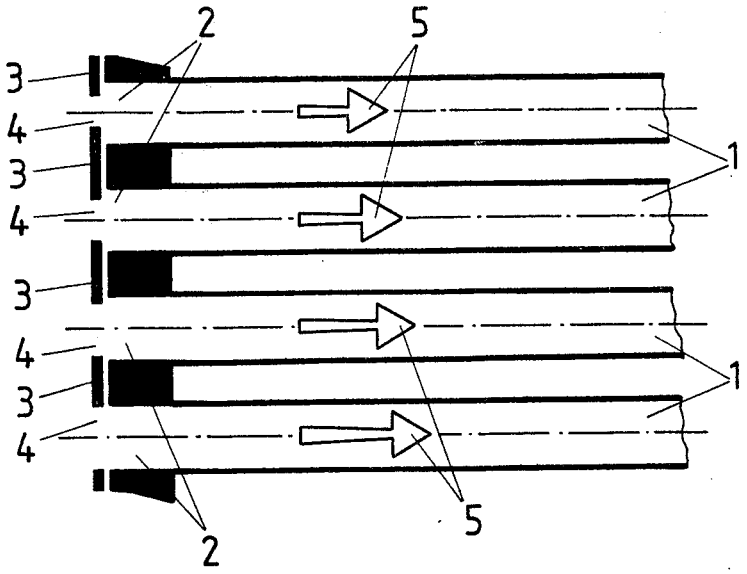
FIG. 1 is a schematic representation of an installed baffle system where the flow rate of the heating steam is related to the thermal load of the tubes.

With reference to FIG. 1, the tubes 1 of a heat exchanger 6, designed as a superheater, is provided with baffles 3, possessing variously sized openings 4, inserted at heating steam intake ends 2 of the tubes 1. The placement of baffles 3, possessing variously sized baffle openings 4, makes it possible to relate the tubes subjected to a lesser load to the thermal load ΔT (in accordance with the length of the arrows 5 which are illustrated in the drawing and which represent the flow rate of the heating steam). In this way the scavenging steam rate at each tube 1 will correspond to the minimum rate required.

Figure 2:
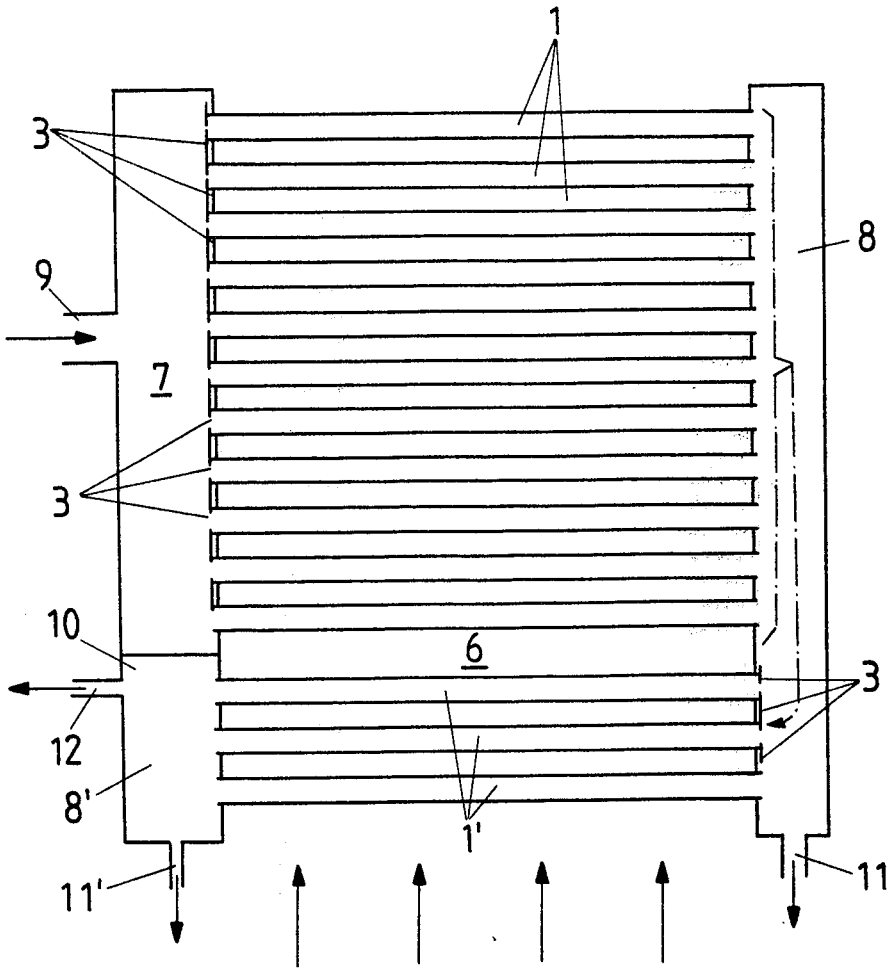
FIG. 2 is a schematic representation of bundles of of heat exchanger tubes with inserted baffles.

With reference to FIG. 2 the tubes of a superheater 6, provided with two pass-throughs, are concentrated into bundles 1 and 1' which connect an inlet manifold 7 with collecting chambers 8, 8'. At the inlet manifold 7 there is arranged a heating steam intake 9, the inlet manifold 7 being separated from the collecting chamber 8' by a partition 10. The collecting chambers 8, 8' are provided with one opening each, 11 and 11' respectively, to drain the condensed water, and the collecting chamber 8' is provided with a scavenging steam outlet 12. At the intake openings of the tubes 1, 1' there are placed the baffles 3, their intake profile being smaller at the tubes which are subjected to a lesser load than at the tubes under high thermal stress.

Figure 3:
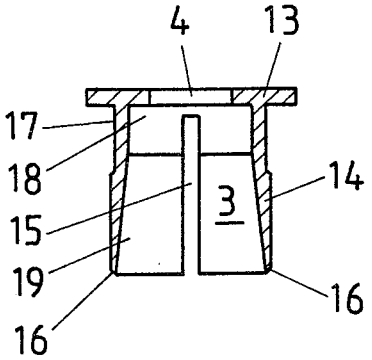
FIG. 3 is a view of a baffle as in the present invention in longitudinal cross section.

The baffle body or member 3 (depicted in FIG. 3) is preferably made of stainless steel and consists of a slotted, cylindrical bushing 14 which has at its entry side a defined baffle opening 4, allowing the setting of a suitable pressure drop in the individual pipes 1. The baffle opening 4 is surrounded by a collar 13 which protrudes over the cylindrical bushing 14 of the baffle body. The cylindrical bushing 14 is pushed into the respective tube up to this collar 13. The cylindrical bushing 14 has a diameter which is preferably slightly greater than the inner tube diameter of the intermediate superheater. A slot 15 is arranged at the bushing which allows an elastic deformation of the cylindrical bushing 14 when it is pushed into a tube 1 or 1' respectively, causing the baffle 3 to lock in the tube entrance. At the other end of the cylindrical bushing 14 there is provided a bevel-like slope 16 which facilitates the insertion into tubes 1, 1' and which prevents damages to their inner surfaces. At the outer contour of the cylindrical bushing 14 there is arranged in back of the collar 13 an eccentric relief 17 to insure that the baffle 3 will join the tube entrance only with its exit-facing half so that the required springy travel can be accomplished without plastic deformation. The baffle opening 4 leads by way of a abrupt profile widening 18 into the inner cylindrical part of bushing 14 which is followed by a conically widening part 19. This arrangement avoids the formation of a separating edge at the baffle exit which could produce erosion-causing vortices. The baffle arrangement proposed by the invention operates as follows: The temperature difference between the heating and the power steam decreases in the direction of flow of the last-mentioned medium. Within one pass-through there will always be some tubes with a great temperature difference and some tubes with a small temperature difference. The exchanged heat is functionally related to the temperature difference so that in the tubes with a large ΔT a greater quantity of heating steam can condense than in tubes with a small ΔT. Assuming that the heating steam pressure loss, which must have the same magnitude for the tubes of one nest of tubes, is proportional to the rate of flow of the heating steam, it will be possible to set in the tubes with large ΔT, subjected to a greater stress, the minimum scavenging steam rate required while at the tubes which are subjected to a lesser load, there will emerge a substantially greater quantity of uncondensed heating steam than it is necessary for maintaining safety of operation. During its travel through the tubes of the bundles 1, 1' the heating steam flows through the nests of tubes 1, 1' (as illustrated) from the top to the bottom. The power steam flows inversely thereto about the tubes of the bundles from the bottom to the top as indicated by the arrows. As a result of the counterflow principle within one unit, the coldest power steam will encounter first that residual portion of the heating steam which is most enriched with non-condensible gases and which has the lowest pressure and thus the lowest temperature. Non-condensed steam and non-condensible gases are removed at the scavenging steam outlet 12.

Again with reference to FIG. 2, a superheater 6 is equipped with two pass-throughs 1, 1'. Steam arrives through the heating steam intake 9 at the inlet manifold 7 from where it will enter the individual tubes 1. The baffles 3 are arranged at the intake openings of the tubes 1, and specifically in such manner that baffles 3 with a small baffle profile 4 are placed at the intakes of tubes 1 that are subjected to the lowest thermal load, with the result that the passage of steam through these tubes is being reduced so that the quantity of non-condensed steam will also be reduced without the danger of a blockage of the steam flow by condensed water. After flowing through the pipes 1, the heating steam reaches the collecting chamber 8 and is guided there into the second pass-through of the superheater 6 (as indicated by the dot and dash lines). In front of the entry into the tubes 1' there are again placed baffles 3 at the individual tubes 1', the baffles being provided with openings of various sizes. Upon completion of its flow through the tubes 1', the residual non-condensed heating steam reaches the scavenging steam outlet 12 by way of the collecting chamber 8'. The condensed water which has accumulated in the collecting chambers 8, 8' is removed through the openings 11, 11'. While the heating steam flows through the tubes 1, 1' of the superheater 6 in horizontal direction, as illustrated in the examples shown by the drawing, the power steam flows around the tubes 1, 1' in vertical direction (as indicated by arrows) to be heated. In other words, the power steam and the heating steam are flowing in cross-counterflow relative to each other. The control of the heating steam flow, made possible by the present invention, will allow a reduction in the number of pass-throughs from the standard set of three pass-throughs to a set of two.

The principles, preferred embodiments, and operation of the present invention have been described in the foregoing specification. The invention which is intended to be protected herein, however, is not to be construed as limited to the particular forms disclosed, since these are to be regarded as illustrative rather than restrictive. Variations or changes may be made by those skilled in the art without departing from the spirit of the present invention.

What is claimed is:

1. In a heat exchanger having tubes combined into at least two horizontally arranged bundles with heating steam flowing into the tubes and a heating working medium flowing around the tubes, the tube bundles being streamed in series by the heating steam and circumflowed in series by the working medium and wherein the individual bundles are connected flow-upstream with a distribution chamber and flow-downstream with a drainable collecting chamber, the individual tube bundles having different heat exchanging surfaces such that the heating steam flow cross section of the tube bundles decreases in the direction of flow of the heating steam, the improvement comprising orifices with different inlet cross sections arranged at the inlet openings of each of the tubes streamed by the heating steam, said orifices being arranged such that within each tube bundle the inlet cross sections become smaller in the direction of flow of the heating working medium.

2. A heat exchanger comprising:

a first plurality of horizontal heat exchanger tubes arranged in a first bundle with first and second sides along a longitudinal length of the first plurality of tubes;

means for distributing heating steam to an inlet end of the first plurality of tubes;

a first plurality of baffle members having openings of different flow cross sectional area, each of the plurality of baffle members being arranged at an inlet end of a corresponding one of the first plurality of tubes;

a collection chamber connected to an outlet end of the first plurality of tubes, said collection chamber having means for selectively draining the collection chamber;

a second plurality of horizontal tubes arranged in a second bundle with first and second sides along a longitudinal length of the second plurality of tubes and having an inlet end connected to the collection chamber, the second plurality of tubes having a smaller flow cross sectional area than the first plurality of tubes;

a second plurality of baffle members having openings of different flow cross sectional area, each of the second plurality of baffle members being arranged at an inlet end of a corresponding one of the second plurality of tubes;

means for flowing a fluid to be heated serially across the second and first bundles of tubes respectively from the first side towards the second side of each bundle; and said baffle members being arranged in each bundle such that the cross sectional area of the openings of each of the baffle members decreases when viewed from the first side towards the second side.

3. The heat exchanger of claim 2 wherein each of the baffle members is inserted in a respective inlet end of one of the tubes.

4. The heat exchanger of claim 3 wherein each of the baffle members is removable.

5. The heat exchanger of claim 2 wherein each of the baffle members comprises:

a first portion consisting of a cylindrical bushing having a slot running lengthwise, said bushing having an outside diameter in a free state which diameter is slightly larger than an inside diameter of the corresponding one of the tubes; and a second portion consisting of a collar arranged at a first end of the bushing wherein an outside diameter of the collar is greater than an outside diameter of the corresponding one of the tubes, said collar having the opening which defines the flow cross sectional area of the baffle member.

6. The heat exchanger of claim 5 wherein an inside surface of the bushing tapers conically outwardly toward a second end of the bushing whereby flow separations at the second end are avoided.

7. The heat exchanger of claim 5 further comprising an eccentric relief provided on an outside surface of the bushing adjacent to the collar.

* * * * *